US008748811B2

(12) United States Patent
Okumura

(10) Patent No.: US 8,748,811 B2
(45) **Date of Patent: *Jun. 10, 2014**

(54) MS/MS MASS SPECTROMETER

(75) Inventor: Daisuke Okumura, Nagaokakyo (JP)

(73) Assignee: Shimadzu Corporation, Kyoto-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/589,989

(22) Filed: Aug. 20, 2012

(65) Prior Publication Data

US 2013/0214146 A1 Aug. 22, 2013

Related U.S. Application Data

(63) Continuation of application No. 13/145,769, filed as application No. PCT/JP2009/000443 on Feb. 5, 2009, now Pat. No. 8,269,166.

(51) Int. Cl.
*H01J 49/26* (2006.01)
*H01J 49/42* (2006.01)

(52) U.S. Cl.
USPC ..... 250/288; 250/281; 250/282; 250/283

(58) Field of Classification Search
USPC ..... 250/288, 281, 282, 283
See application file for complete search history.

(56) References Cited

U.S. PATENT DOCUMENTS 3,404,849 A 10/1968 Howard ..... 242/354.2
6,680,475 B2 * 1/2004 Krutchinsky et al. ..... 250/281
8,269,166 B2 * 9/2012 Okumura ..... 250/288
2010/0012835 A1 * 1/2010 Okumura et al. ..... 250/288
2011/0006203 A1 * 1/2011 Fujita et al. ..... 250/288

FOREIGN PATENT DOCUMENTS

JP 07-201304 12/1993 ..... 250/281

OTHER PUBLICATIONS

API 4000™ LC/MS/MS System, Applied Biosystems Japan Kabushiki Kaisha, Feb. 2, 2009.

* cited by examiner

*Primary Examiner* — Nikita Wells
(74) *Attorney, Agent, or Firm* — Bingham McCutchen LLP

(57) ABSTRACT

A mass analysis of a sample having a known mass-to-charge ratio is carried out by performing a scan at a first-stage quadrupole over a predetermined mass range, under the condition that a collision induced dissociation gas is introduced into a collision cell and a voltage applied to a third-stage quadrupole is set so that no substantial mass separation occurs in this quadrupole. Various product ions originating from a precursor ion selected by the first-stage quadrupole arrive at and are detected by a detector without being mass separated. Accordingly, based on the detection data, a data processor can obtain a relationship between the voltage applied to the first-stage quadrupole and the mass-to-charge ratio of the selected ions, with a time delay in the collision cell reflected in that relationship. This relationship is stored in a calibration data memory, to be utilized in a neutral loss scan measurement or the like.

10 Claims, 5 Drawing Sheets

Fig. 1
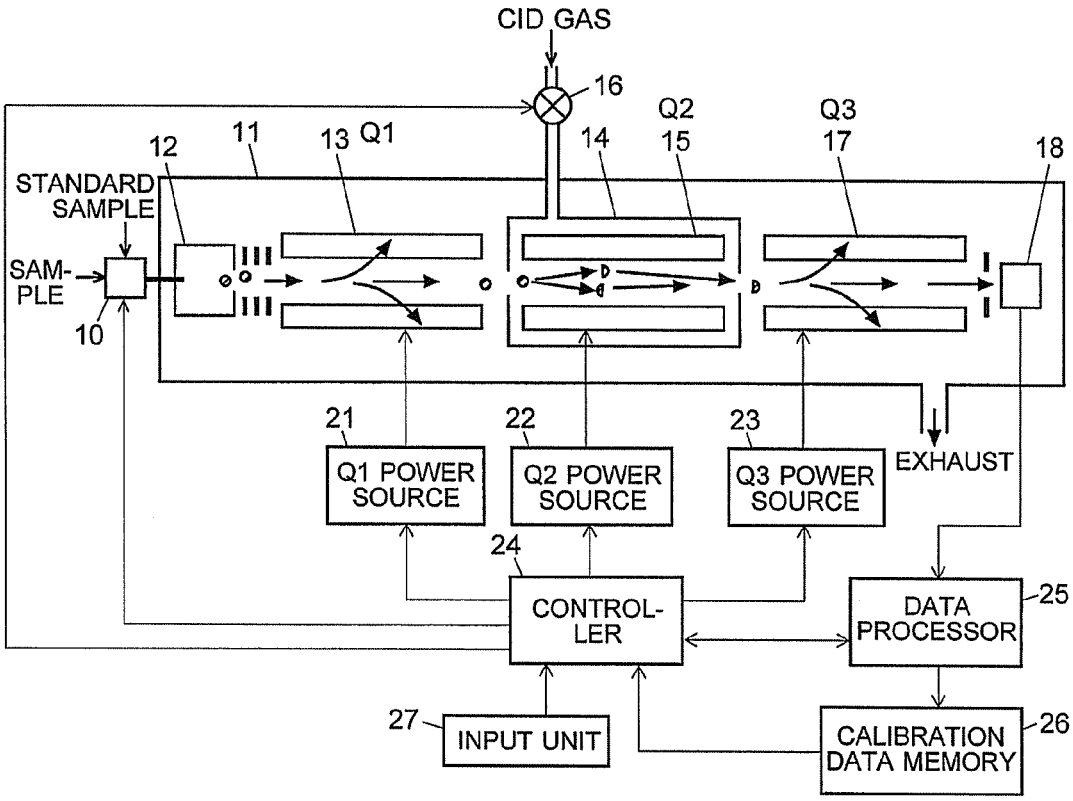
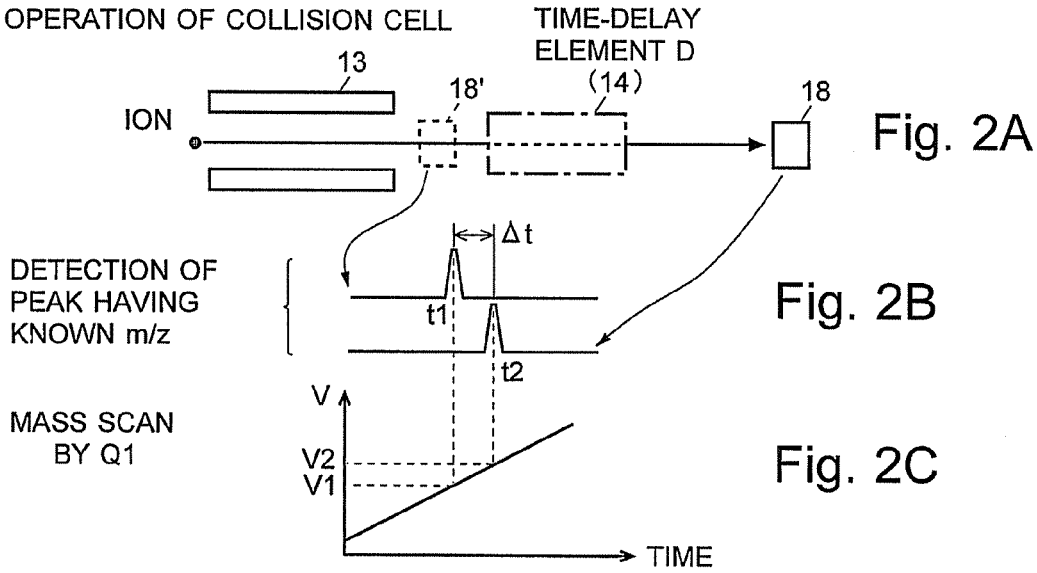

METHOD 1: CHANGING m/z AT WHICH IONS CAN PASS THROUGH Q3

METHOD 2: LOWERING MASS-RESOLVING POWER OF Q3

METHOD 1: CHANGING NEUTRAL LOSS

METHOD 2: LOWERING MASS-RESOLVING POWER OF Q3

MASS ANALYSIS DATA

RESOLVING-POWER ADJUSTMENT DATA

MS/MS MASS SPECTROMETER

TECHNICAL FIELD

The present invention relates to an MS/MS mass spectrometer for dissociating an ion having a specific mass-to-charge ratio (m/z) by Collision-Induced Dissociation (CID) and for performing a mass analysis of product ions (fragment ions) generated by the dissociation.

BACKGROUND ART

An MS/MS analysis (which may also be referred to as a tandem analysis) is known as one of the mass spectrometric methods for identifying a substance with a large molecular weight and for analyzing its structure. A triple quadrupole (TQ) mass spectrometer is a typical MS/MS mass spectrometer. FIG. 6 is a schematic configuration diagram of a generally used triple quadrupole mass spectrometer disclosed in Patent Documents 1, 2 or other documents.

This mass spectrometer has an analysis chamber 11 evacuated by a vacuum pump (not shown). In this chamber 11, an ion source 12 for ionizing a sample to be analyzed, three quadrupoles 13, 15 and 17, each of which is composed of four rod electrodes, and a detector 18 for detecting ions and producing detection signals corresponding to the amount of detected ions, are arranged on an approximately straight line. A voltage composed of a DC voltage and a radio-frequency (RF) voltage is applied to the first-stage quadrupole (Q1) 13. Due to the effect of the quadrupole electric field generated by this composite voltage, only a target ion having a specific mass-to-charge ratio is selected as a precursor ion from various kinds of ions produced by the ion source 12. The mass-to-charge of the ion that is allowed to pass through the first-stage quadrupole 13 can be varied over a specific range by appropriately changing the DC voltage and the radio-frequency voltage applied to the first-stage quadrupole 13 while maintaining a specific relationship between them.

The second-stage quadrupole (Q2) 15 is contained in a highly airtight collision cell 14. A CID gas, such as argon (Ar) gas, is introduced into this collision cell 14. After being sent from the first-stage quadrupole 13 to the second-stage quadrupole 15, the precursor ion collides with the CID gas in the collision cell 14, to be dissociated into product ions by a CID process. This dissociation can occur in various forms. Normally, one kind of precursor ion produces plural kinds of product ions having different mass-to-charge ratios. These plural kinds of product ions are extracted from the collision cell 14 and introduced into the third-stage quadrupole (Q3) 17. In most cases, a pure radio-frequency voltage or a voltage generated by adding a DC bias voltage to the radio-frequency voltage is applied to the second-stage quadrupole 15 to make this quadrupole function as an ion guide for transporting ions to the subsequent stages while converging these ions.

Similar to the first-stage quadrupole 13, a voltage composed of a DC voltage and a radio-frequency voltage is applied to the third-stage quadrupole 17. Due to the effect of the quadrupole electric field generated by this voltage, only a product ion having a specific mass-to-charge ratio is selected in the third-stage quadrupole 17, and the selected ion reaches the detector 18. The mass-to-charge ratio of the ion that is allowed to pass through the third-stage quadrupole 17 can be varied over a specific range by appropriately changing the DC voltage and the radio-frequency voltage applied to the third-stage quadrupole 17 while maintaining a predetermined relationship between them. Based on the detection signals produced by the detector 18 during this operation, a data processor (not shown) creates a mass spectrum of the product ions resulting from the dissociation of the target ion.

As described in Patent Document 2, the previously described mass spectrometer is capable of MS/MS analyses, such as a neutral loss scan measurement or precursor ion scan measurement. FIGS. 7A and 7B are model diagrams schematically showing how the mass-to-charge ratio of ions passing through the first-stage and third-stage quadrupoles 13 and 17 is changed in each of the aforementioned measurement modes: In the neutral loss scan measurement, as shown in FIG. 7A, a mass scan is performed while maintaining the mass difference (neutral loss) $\Delta M$, i.e. the difference between the mass-to-charge ratio of the ions passing through the first-stage quadrupole 13 and that of the ions passing through the third-stage quadrupole 17. In the precursor ion scan measurement, as shown in FIG. 7B, the mass-to-charge ratio of the ions passing through the first-stage quadrupole 13 is changed while that of the ions passing through the third-stage quadrupole 17 is fixed at a certain value.

Another mode of the measurement that can be performed using a MS/MS mass spectrometer is a so-called auto MS/MS analysis, in which a specific kind of precursor ion that matches predetermined conditions is automatically detected and subjected to an MS/MS analysis. In this technique, a normal mode of mass analysis, which does not involve any dissociation process in the collision cell 14 or a mass-separation process by the third-stage quadrupole 17, is carried out to obtain a mass spectrum, immediately after which a data processing for automatically detecting a peak that matches predetermined conditions is performed on each of the peaks appearing on that mass spectrum. Then, an MS/MS analysis is performed for the detected peak, with the mass-to-charge ratio of that peak as the precursor ion, to create a mass spectrum of product ions.

The triple quadrupole mass spectrometer can perform the previously described various modes of MS/MS analyses including a dissociating operation. However, the following problem occurs since the dissociation of ions in the collision cell 14 occurs in the middle of their flight through a vacuum atmosphere:

The gas pressure inside the collision cell 14 is maintained at around several hundred mPa due to the almost continuous supply of the CID gas into the collision cell 14. This pressure is considerably higher than the gas pressure inside the analysis chamber 11 and outside the collision cell 14. When ions travel through a radio-frequency electric field under such a relatively high gas pressure, they gradually lose their kinetic energies due to collision with the gas, which decreases their flight speed. Therefore, a significant time delay occurs when the ions pass through the collision cell 14.

In the neutral loss scan measurement, the mass-scan operations of the first-stage and third-stage quadrupoles 13 and 17 are linked with each other. If a significant time delay of the ions occurs in the collision cell 14, which is located between the two quadrupoles, the mass-to-charge ratio of the ions actually analyzed in the third-stage quadrupole 17 will be different from the desired mass-to-charge ratio for the mass analysis. This causes the mass-to-charge ratio of the neutral loss to be shifted from the intended value, with a possible deterioration in the analysis sensitivity. In the auto MS/MS analysis, a similar deterioration in sensitivity of the analysis can occur due to a shift of the mass-to-charge ratio of the precursor ion selected by the first cycle of the mass analysis.

Furthermore, in any of the aforementioned measurement modes, the time delay of the ions in the collision cell 14 is not reflected in the mass spectrum. This means that the mass axis of the mass spectrum may be significantly shifted, causing a problem in the quantitative or qualitative analysis based on the mass spectrum.

To reduce the influence of the time delay of the ions in the collision cell 14, it is necessary to lower the scan speed in the mass-scan operation. However, this broadens the time interval of a repetitive measurement and thereby increases the possibility of missing a component in an LC/MS or GC/MS analysis. In recent years, the delay of the ions has been considerably reduced as a result of the development of high-speed collision cells, such as the products marketed as LINIAC™ or T-Wave™ (see Non-Patent Documents 1 and 2). However, even when such a high-speed collision cell is used, ions require several milliseconds to pass through the cell, so that the aforementioned sensitivity deterioration or mass shift will inevitably occur when the mass-scan speed is increased to a level around 1000 u/sec or higher.

Patent Document 1: JP-A 07-201304

Patent Document 2: JP-B 3,404,849

Non-Patent Document 1: API 4000™ LC/MS/MS System, [online], Applied Biosystems Japan Kabushiki Kaisha, [searched on Feb. 2, 2009], Internet <URL: http://www.appliedbiosystems.co.jp/website/jp/product/modelpage.jsp?MODELCD=253&MODELPGCD=22242>

Non-Patent Document 2: Tandem Quadrupole UPLC/MS Detector "ACQUITY™ TQD", [online], Nihon Waters K. K., [searched on Feb. 2, 2009], Internet <URL: http://www.waters.co.jp/company/information/>

DISCLOSURE OF THE INVENTION

Problem to be Solved by the Invention

The present invention has been developed to solve the aforementioned problem, and one objective thereof is to provide an MS/MS mass spectrometer capable of preventing a mass shift or sensitivity deterioration in various modes of measurements, such as a neutral loss scan measurement, precursor ion scan measurement or auto MS/MS analysis.

Means for Solving the Problems

The first aspect of the present invention aimed at solving the aforementioned problem is an MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, and the MS/MS mass spectrometer further includes:

a) a calibrating analysis execution means for collecting mass analysis data by analyzing a sample having a known mass-to-charge ratio by performing a mass scan in the first mass separator under a condition that a CID gas is introduced into the collision cell while no substantial mass separation is performed in the second mass separator;

b) a calibration information memory means for creating mass calibration information for the first mass separator unit, based on the mass analysis data collected by the calibrating analysis execution means, the mass calibration information reflecting a time delay of an ion in the collision cell, and for memorizing the mass calibration information; and c) an actual analysis execution means for collecting mass analysis data for a target sample by controlling a mass-scan operation of the first mass separator by using the mass calibration information memorized in the calibration information memory means, at least when a neutral loss scan or a precursor ion scan is performed.

In the case of a normal type of MS/MS mass spectrometer, mass calibration information is obtained by performing a mass analysis of a standard sample having a known mass-to-charge ratio without introducing any CID gas into the collision cell. By contrast, in the MS/MS mass spectrometer according to the present invention, the mass analysis of the standard sample is performed in a manner similar to the normal MS/MS analysis, i.e. under the condition that a CID gas is introduced into the collision cell. During this process, an ion having a specific mass-to-charge ratio selected by the first mass separator is dissociated into product ions in the collision cell. These product ions are allowed to reach the detector in the form of a packet, i.e. without undergoing mass separation.

The period of time required for ions to pass through the first or second mass separator is sufficiently shorter than the period of time required for the ions to pass through the collision cell, which is maintained at a high pressure due to the introduction of the CID gas. Therefore, it is possible to consider that the mass analysis data collected by the calibrating analysis execution means reflects a time delay caused by the CID gas in the collision cell. Accordingly, based on this mass analysis data, the calibration information memory means creates and memorizes mass calibration information which reflects the time delay of the ions in the collision cell.

As in the case of the neutral loss scan or precursor ion scan, when a measurement including the mass-scan operation of the first mass separator and the dissociating operation of the collision cell is carried out, the actual measurement performance means controls the mass-scan operation of the first mass separator, using the mass calibration information memorized in the calibration information memory means. By using this information, the mass-scan operation is appropriately controlled so that the influence of a mass shift due to the time delay of the ions in the collision cell will be corrected. Therefore, for example, in a neutral loss scan measurement, neutral losses will be detected at correct mass-to-charge ratios as intended by the user, so that the target ions can be detected with high sensitivity. Furthermore, the shift of the mass axis of the mass spectrum will be cancelled.

The time delay of the ions passing through the collision cell depends on various factors, such as the pressure of the CID gas, the collision energy, and the mass-scan speed of the first mass separator. Accordingly, in a preferable mode of the MS/MS mass spectrometer according to the present invention, the calibrating analysis execution means collects mass analysis data under various conditions in which at least one among (a) the pressure of the CID gas in the collision cell, (b) the collision energy, and (c) the mass-scan speed of the first mass separator is varied in plural ways, and the calibration information memory means creates and memorizes mass calibration information for each different condition.

The second aspect of the present invention aimed at solving the aforementioned problem is an MS/MS mass spectrometer including a first mass separator for selecting, as a precursor ion, an ion having a specific mass-to-charge ratio from various kinds of ions, a collision cell for dissociating the precursor ion by making the precursor ion collide with a CID gas, and a second mass separator for selecting an ion having a specific mass-to-charge ratio from various kinds of product ions created by dissociation of the precursor ion, and the MS/MS mass spectrometer further includes:

a) an input means for allowing a user to input a difference in the mass-to-charge ratio between the first mass separator and the second mass separator in a neutral loss scan measurement, or to input information based on which the aforementioned difference in the mass-to-charge ratio can be determined;

b) a correction means for correcting the difference in the mass-to-charge ratio inputted through the input means or calculated on a basis of the aforementioned information, by adding a predetermined value to the difference in the mass-to-charge ratio; and c) a measurement execution means for controlling mass-scan operations of the first mass separator and the second mass separator so as to perform a neutral loss scan measurement based on the corrected value of the difference in the mass-to-charge ratio.

In the neutral loss scan measurement, if a significant time delay of ions occurs in the collision cell in the previously described manner, the arrival at the second mass separator of a target product ion originating from the precursor ion will be temporally delayed from the expected point in time. As a result, the actual difference between the mass-to-charge ratio of the ions selected in the first mass separator and that of the ions selected in the second mass separator decreases. Given this problem, in the MS/MS mass spectrometer according to the second aspect of the present invention, the correction means corrects the mass-to-charge ratio of the neutral loss specified by the user, to a value that exceeds the user-specified value by an amount corresponding to the time delay of the ions in the collision cell. This additional amount of the mass-to-charge ratio can be determined, for example, based on a value experimentally determined beforehand by a manufacturer of the device. It is naturally possible to add a function for obtaining the additional amount of the mass-to-charge ratio by measuring a standard sample or the like on the user's part.

To more accurately correct the mass shift, it is preferable for the MS/MS mass spectrometer according to the second aspect of the present invention to further include a memory means in which information on the additional value for correcting the difference in the mass-to-charge ratio is held for each of a variety of values in which at least one factor among (a) the pressure of the CID gas in the collision cell, (b) the collision energy, and (c) the mass-scan speed of the first mass separator is varied, and the correction means corrects the difference in the mass-to-charge ratio by using the information memorized in the memory means.

As just described, in the second aspect of the present invention, a mass-to-charge ratio value corresponding to the time delay of the ions in the collision cell is added to the mass-to-charge ratio of the neutral loss. Alternatively, the point of initiation of the mass-scan operation of the second mass separator may be delayed by a period of time corresponding to the aforementioned time delay to obtain an effect similar to the effect of the second aspect of the present invention.

Accordingly, the third aspect of the present invention aimed at solving the aforementioned problem is an MS/MS mass spectrometer including a first mass separator for selecting, as a precursor ion, an ion having a specific mass-to-charge ratio from various kinds of ions, a collision cell for dissociating the precursor ion by making the precursor ion collide with a CID gas, and a second mass separator for selecting an ion having a specific mass-to-charge ratio from various kinds of product ions created by dissociation of the precursor ion, and the MS/MS mass spectrometer further includes:

a) an input means for allowing a user to input a difference in the mass-to-charge ratio between the first mass separator and the second mass separator in a neutral loss scan measurement, or to input information based on which the aforementioned difference in the mass-to-charge ratio can be determined; and b) a measurement execution means for conducting mass-scan operations of the first mass separator and the second mass separator so as to perform a neutral loss scan measurement based on the difference in the mass-to-charge ratio inputted through the input means or calculated on a basis of the aforementioned information, wherein a point of initiation of the mass-scan operation of the second mass separator is delayed from a point of initiation of the mass-scan operation of the first mass separator by a previously determined period of time.

To correct the mass shift more accurately, it is preferable for the MS/MS mass spectrometer according to the third aspect of the present invention to further include a memory means in which time information used for delaying the point of initiation of the mass-scan operation of the second mass separator is held for each of a variety of values in which at least one factor among (a) the pressure of the CID gas in the collision cell, (b) the collision energy, and (c) the mass-scan speed of the first mass separator is varied, and the measurement execution means uses the time information held in the memory means to delay the initiation of the mass-scan operation of the second mass separator from the point of initiation of the mass-scan operation of the first mass separator by the previously determined period of time.

In the MS/MS mass spectrometer according to the first aspect of the present invention, the various kinds of ions created by the collision cell are allowed to pass through the second mass separator, without undergoing substantial mass separation, and then detected. Therefore, a mass analysis data that reflects the time delay of the ions in the collision cell can be collected even if the mass-to-charge ratio of a product ion originating from a sample for calibration are unknown, or even if the mass calibration of the second mass separator has not been correctly performed. In other words, when the mass-to-charge ratio of the product ion concerned is known and the mass calibration of the second mass separator is correct, it is possible to obtain data available for creating mass calibration information for the first mass separator, even if the mass separation in the second mass separator is performed in such a manner that only the product ion concerned is selectively allowed to pass through. Furthermore, even if the mass-to-charge ratio of a product ion originating from the sample for calibration is unknown or can only be roughly estimated, or even if the mass calibration of the second mass separator is insufficient, it is possible to obtain data available for creating mass calibration information for the first mass separator, by lowering the mass-resolving power of the second mass separator so that a group of ions spread over a certain range of mass-to-charge ratio can be collectively detected, or by performing a plurality of analyses while gradually changing the mass-to-charge ratio to be selected by the second mass separator.

Accordingly, the fourth aspect of the present invention aimed at solving the aforementioned problem provides an MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, and the MS/MS mass spectrometer further includes:

a) a calibrating analysis execution means for collecting mass analysis data by introducing a CID gas into the collision cell, by operating the first mass separator to perform a mass scan of a sample having a known mass-to-charge ratio, and by operating the second mass separator to selectively analyze a product ion originating from the sample;

b) a calibration information memory means for creating mass calibration information for the first mass separator, based on the mass analysis data collected by the calibrating analysis execution means, the mass calibration information reflecting a time delay of an ion in the collision cell, and for memorizing the mass calibration information; and c) an actual analysis execution means for collecting mass analysis data for a target sample by controlling a mass-scan operation of the first mass separator by using the mass calibration information memorized in the calibration information memory means, at least when a neutral loss scan or a precursor ion scan is performed.

That is to say, in the MS/MS mass spectrometer according to the fourth aspect of the present invention, the calibrating analysis execution means performs a precursor ion scan mode to collect mass analysis data used for the mass calibration. As already explained, when the mass-to-charge ratio of the product ion originating from the sample for calibration is known and the mass calibration of the second mass separator is to some extent correct, the product ion originating from the sample for calibration can be assuredly detected, so that the analysis using the calibrating analysis execution means needs to be performed only one time. By contrast, when the mass-to-charge ratio of the product ion originating from the sample for calibration is unknown, or when the mass calibration of the second mass separator is not sufficiently accurate, it is possible that the product ion originating from the sample for calibration cannot be detected by performing the analysis only one time. In such a case, the calibrating analysis execution means can perform the analysis a plurality of times while changing the mass-to-charge ratio to be selected by the second mass separator, or perform a rough analysis using the second mass separator at a low mass-resolving power to roughly locate the product ion originating from the sample for calibration and then repeat a plurality of analyses while gradually increasing mass-resolving power.

It is also possible to construct the calibrating analysis execution means so that it uses a neutral loss scan mode to collect mass analysis data for mass calibration. Thus, the fifth aspect of the present invention aimed at solving the aforementioned problem provides an MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, and the MS/MS mass spectrometer further includes:

a) a calibrating analysis execution means for collecting mass analysis data by introducing a CID gas into the collision cell and synchronously driving the first mass separator and the second mass separator to perform a neutral loss scan aimed at a known or expected neutral loss for a sample having a known mass-to-charge ratio;

b) a calibration information memory means for creating mass calibration information for the first mass separator, based on the mass analysis data collected by the calibrating analysis execution means, the mass calibration information reflecting a time delay of an ion in the collision cell, and for memorizing the mass calibration information; and c) an actual analysis execution means for collecting mass analysis data for a target sample by controlling a mass-scan operation of the first mass separator by using the mass calibration information memorized in the calibration information memory means, at least when a neutral loss scan or a precursor ion scan is performed.

In the fifth aspect of the present invention, even when the mass calibration of the second mass separator is to some extent correct, if a large mass shift occurs in the first mass separator, the product ion originating from the sample for calibration may be prevented from being detected by the neutral loss scan aimed at a known or expected neutral loss for the sample for calibration. In such a case, the calibrating analysis execution means can perform the analysis a plurality of times while gradually changing the setting of the neutral loss, or perform a rough analysis using the second mass separator at a low mass-resolving power to roughly locate the product ion originating from the sample for calibration and then a plurality of analyses while gradually increasing mass-resolving power.

As described previously, no mass separation is performed in the second mass separator in the first aspect of the present invention. By contrast, in the fourth or fifth aspect of the present invention, mass separation is performed in the second mass separator, so that the product ion originating from the sample for calibration may be prevented from passing through the second mass separator and being detected. Therefore, in some cases, the analysis of the sample for calibration must be repeated a plurality of times while changing the mass-resolving power and other parameters. However, once the product ion originating from the sample for calibration is located, it is possible to obtain mass analysis data necessary for the mass calibration and perform the mass calibration of the first mass separator, as in the case of the first aspect of the present invention.

In the MS/MS mass spectrometer according the first, fourth or fifth aspect of the present invention, when the neutral loss scan measurement or precursor ion scan measurement is performed, a mass scan is performed using the first mass separator in which the mass shift has been corrected. It is also possible to adjust the mass-resolving power of the first mass separator together with or separately from the correction of the mass shift. When a CID gas is present in the collision cell, if ions having the same mass-to-charge ratio are simultaneously injected into the collision cell, the variation in the amount of kinetic energy of these ions may increase due to the collision with the CID gas, causing a change in the speed of the ions, which leads to an increase in the variation of the time of arrival of the ions at the detector. As a result, the mass-resolving power will deteriorate. To address this problem, information for adjusting the mass-resolving power of the first mass separator may be obtained, similar to the mass calibration information for the first mass separator, under the condition that a CID gas is present in the collision cell.

Accordingly, the sixth aspect of the present invention provides an MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, and the MS/MS mass spectrometer further includes:

a) an adjusting analysis execution means for collecting mass analysis data by analyzing a sample having a known mass-to-charge ratio by performing a mass scan in the first mass separator under a condition that a CID gas is introduced into the collision cell while no substantial mass separation is performed in the second mass separator;

b) an adjustment information memory means for creating mass-resolving power adjustment information for the first mass separator, based on the mass analysis data collected by the adjusting analysis execution means, the mass-resolving power adjustment information reflecting an increase in the variation of the kinetic energies of ions in the collision cell, and for memorizing the mass-resolving power adjustment information; and c) an actual analysis execution means for collecting mass analysis data for a target sample by controlling a mass-scan operation while using the mass-resolving power adjustment information memorized in the calibration information memory means so that the mass-resolving power of the first mass separator will be adjusted to a target value, at least when a neutral loss scan or a precursor ion scan is performed.

The seventh aspect of the present invention is an MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, and the MS/MS mass spectrometer further includes:

a) an adjusting analysis execution means for collecting mass analysis data by introducing a CID gas into the collision cell, by operating the first mass separator to perform a mass scan of a sample having a known mass-to-charge ratio, and by operating the second mass separator to selectively analyze a product ion originating from the sample;

b) an adjustment information memory means for creating mass-resolving power adjustment information for the first mass separator, based on the mass analysis data collected by the adjusting analysis execution means, the mass-resolving power adjustment information reflecting an increase in the variation of the kinetic energies of ions in the collision cell, and for memorizing the mass-resolving power adjustment information; and c) an actual analysis execution means for collecting mass analysis data for a target sample by controlling a mass-scan operation while using the mass-resolving power adjustment information memorized in the calibration information memory means so that the mass-resolving power of the first mass separator will be adjusted to a target value, at least when a neutral loss scan or a precursor ion scan is performed.

The eighth aspect of the present invention is an MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, and the MS/MS mass spectrometer further includes:

a) an adjusting analysis execution means for collecting mass analysis data by introducing a CID gas into the collision cell and synchronously driving the first mass separator and the second mass separator to perform a neutral loss scan aimed at a known or expected neutral loss for a sample having a known mass-to-charge ratio;

b) an adjustment information memory means for creating mass-resolving power adjustment information for the first mass separator, based on the mass analysis data collected by the adjusting analysis execution means, the mass-resolving power adjustment information reflecting an increase in the variation of the kinetic energies of ions in the collision cell, and for memorizing the mass-resolving power adjustment information; and c) an actual analysis execution means for collecting mass analysis data for a target sample by controlling a mass-scan operation while using the mass-resolving power adjustment information memorized in the calibration information memory means so that the mass-resolving power of the first mass separator will be adjusted to a target value, at least when a neutral loss scan or a precursor ion scan is performed.

In general, a change in the mass-resolving power of a mass separator causes a change in the peak width of an ion peak obtained by the mass scan. In the MS/MS mass spectrometer according to the six aspect of the present invention, since the ions emitted from the collision cell pass through the second mass separator without undergoing any change in motion, the mass analysis data collected by the adjusting analysis execution means directly reflects the change in the speed of the ions due to an increase in the variation of the kinetic energies of the ions in the collision cell. Accordingly, for example, the adjustment information memory means creates and memorizes mass-resolving power adjustment information from the widths of the peaks on a mass spectrum based on the mass analysis data and from the mass-scan conditions in the first mass separator. Using this mass-resolving power adjustment information, the actual analysis execution means controls the mass-scan operation of the first mass separator so that the mass-resolving power will be adjusted to a specified target level. By this control, the mass resolution of the precursor ion is adjusted to the target level when a mass-scan operation, such as a neutral loss scan or precursor ion scan, is performed in the first mass separator.

On the other hand, in the seventh or eighth aspect of the present invention, in which the mass separation of the ions is also carried out in the second mass separator, the mass-resolving power in the second mass separator is also reflected in the mass analysis data collected by the adjusting analysis execution means. Accordingly, in order to obtain mass-resolving power adjustment information necessary for adjusting the mass-resolving power of the first mass separator, the mass-resolving power of the second mass separator may preferably be set at a very low level so that the mass-resolving power of the first mass separator, including the influences from the collision cell, will almost directly appear in the mass analysis data.

Effect of the Invention

The MS/MS mass spectrometer according to any of the first through fifth aspects of the present invention can perform a neutral loss scan measurement or precursor ion scan measurement with a reduced influence from the time delay which occurs when the ions pass through the collision cell, whereby the detection sensitivity for product ions is improved over the entire mass-scan range, and the accuracy of the mass axis of a mass spectrum created in the measurement is also improved. In the case of an auto MS/MS measurement, the detection sensitivity for product ions originating from a target ion is improved, and the accuracy of the mass axis of a mass spectrum created in the measurement is also improved.

In particular, in the MS/MS mass spectrometer according to fourth or fifth aspect of the present invention, since the mass-scan operation is performed not only in the first mass spectrometer but also in the second mass separator in the process of obtaining mass analysis data for mass calibration, the electric field and other conditions which affect the ions until they arrive at the detector are approximately the same as those of the actual MS/MS analysis of a target sample. Therefore, the mass calibration accuracy is higher than in the case of obtaining the mass analysis data for mass calibration without performing the mass separation in the second mass separator.

In the MS/MS mass spectrometer according to the sixth, seventh or eighth aspect of the present invention, when a neutral loss scan measurement or precursor ion scan measurement is performed, the influence of an increase in the variation of the kinetic energy, which occurs while the ions pass through the collision cell, is reduced, so that the mass-resolving power for selecting the precursor ion can be adjusted to a target level. This makes it possible to improve the mass-resolving power for the precursor ion so as to correctly detect only the desired product ion, or to intentionally lower the mass-resolving power for the precursor ion so as to improve the detection sensitivity of the product ion.

BRIEF DESCRIPTION OF THE DRAWINGS

FIG. 1 is a schematic configuration diagram of a triple quadrupole mass spectrometer according to one embodiment (first embodiment) of the present invention.

FIGS. 2A to 2C is a model diagram for explaining an operation characteristic of the triple quadrupole mass spectrometer of the first embodiment.

EXPLANATION OF NUMERALS

Figure 3:
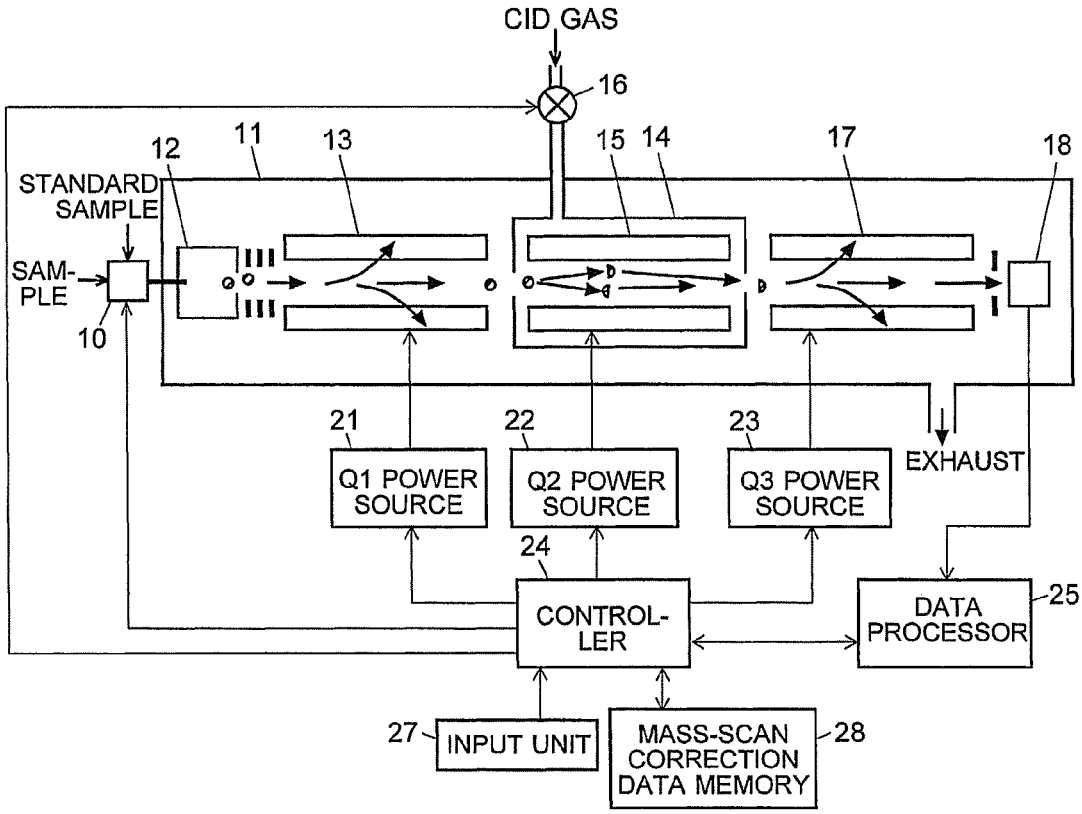
FIG. 3 is a schematic configuration diagram of a triple quadrupole mass spectrometer according to another embodiment (second embodiment) of the present invention.

10 . . . Sample Introduction Unit
11 . . . Analysis Chamber
12 . . . Ion Source
13 . . . First-Stage Quadrupole (Q1)
14 . . . Collision Cell
15 . . . Second-Stage Quadrupole (Q2)
16 . . . Gas Valve
17 . . . Third-Stage Quadrupole (Q3)
18 . . . Detector
21 . . . Q1 Power Source
22 . . . Q2 Power Source
23 . . . Q3 Power Source
24 . . . Controller
25 . . . Data Processor
26 . . . Calibration Data Memory
27 . . . Input Unit
28 . . . Mass-Scan Correction Data Memory
29 . . . Resolving Power Adjustment Data Memory

BEST MODE FOR CARRYING OUT THE INVENTION

First Embodiment

A triple quadrupole mass spectrometer as one embodiment (first embodiment) of the present invention is hereinafter described with reference to the attached drawings. FIG. 1 is a schematic configuration diagram of a triple quadrupole mass spectrometer of the present embodiment, and FIGS. 2A to 2C is model diagrams for explaining an operation characteristic of the triple quadrupole mass spectrometer of the present embodiment.

Similar to the conventional case, the triple quadrupole mass spectrometer of the present embodiment has a first-stage quadrupole 13 (which corresponds to the first mass separator of the present invention) and a third-stage quadrupole 17 (which corresponds to the second mass separator of the present invention), between which a collision cell 14 for dissociating a precursor ion to produce various kinds of product ions is located.

A Q1 power source 21 applies, to the first-stage quadrupole 13, either a composite voltage $\pm(U1+V1\cdot\cos\omega t)$ including a DC voltage U1 and a radio-frequency voltage $V1\cdot\cos\omega t$ or a voltage $\pm(U1+V1\cdot\cos\omega t)+Vbias1$ including the aforementioned composite voltage with a predetermined DC bias voltage Vbias1 added thereto. A Q2 power source 22 applies, to the second-stage quadrupole 15, either a pure radio-frequency voltage $\pm V2\cdot\cos\omega t$ or a voltage $\pm V2\cdot\cos\omega t+Vbias2$ including the radio-frequency voltage with a predetermined DC bias voltage Vbias2 added thereto. A Q3 power source 23 applies, to the third-stage quadrupole 17, either a composite voltage $\pm(U3+V3\cdot\cos\omega t)$ including a DC voltage U3 and a radio-frequency voltage $V3\cdot\cos\omega t$ or a voltage $\pm(U3+V3\cdot\cos\omega t)+Vbias3$ including the aforementioned composite voltage with a predetermined DC bias voltage Vbias3 added thereto. The Q1, Q2 and Q3 power sources 21, 22 and 23 operate under the control of a controller 24.

The detection data obtained with a detector 18 is sent to a data processor 25, which creates a mass spectrum and performs a quantitative or qualitative analysis based on that mass spectrum. A calibration data memory 26 is connected to the data processor 25. The calibration data memory 26 is used to store mass calibration data computed by a measurement and data processing, which will be described later. The controller 24 uses the mass calibration data stored in the calibration data memory 26 to perform a control for the measurement.

An operation characteristic of the triple quadrupole mass spectrometer of the present embodiment is hereinafter described by means of FIGS. 2A to 2C. The present mass spectrometer requires collecting mass calibration data and saving the data in the calibration data memory 26 before the analysis of a target sample. For this purpose, the controller 24 conducts a measurement for mass calibration as follows:

Upon receiving a command for initiating the mass-calibration measurement, the controller 24 operates the sample introduction unit 10 to selectively introduce a standard sample having a known mass-to-charge ratio into the ion source 12, while opening a gas valve 16 to introduce a CID gas into the collision cell 14 at a predetermined flow rate so as to maintain the CID gas pressure in the collision cell 14 at a specific level. The controller 24 also operates the Q3 power source 23 to apply only a radio-frequency voltage to the third-stage quadrupole 17 so that the third-stage quadrupole 17 will merely converge ions without substantially mass-separating them. Alternatively, a composite voltage including a DC voltage U3 and a radio-frequency voltage with amplitude V3 may be applied to the third-stage quadrupole 17, with U3 and V3 being appropriately set so that the mass resolving power will be low enough to avoid mass separation of the product ions created by dissociation in the collision cell 14.

In a normal type of triple quadrupole mass spectrometer, no CID gas is introduced into the collision cell during the process of collecting mass calibration data which shows the relationship between the voltage applied to the first-stage quadrupole 13 and the thereby selected mass-to-charge ratio. By contrast, in the mass-calibration measurement performed by the triple quadrupole mass spectrometer of the present embodiment, a CID gas is introduced into the collision cell 14 to dissociate ions in the collision cell 14 in a manner similar to a normal MS/MS analysis, such as a neutral loss scan measurement.

Since the various kinds of product ions having different mass-to-charge ratios generated by dissociation are not mass separated in the third-stage quadrupole 17, the largest portion of the product ions originating from the same precursor ion remain in the form of a mass when arriving at the detector 18. The ions that have entered the collision cell 14 are decelerated due to collision with the CID gas since the gas pressure in this cell is higher than in the surrounding space. Accordingly, as shown in FIG. 2A, the state of the flight path of the ions during the mass-calibration measurement can be represented by a model in which a time-delay element D due to the collision cell 14 is provided between the first-stage quadrupole 13 and the detector 18. In the spaces outside the collision cell 14, the degree of vacuum is so high that the time delay of the ions in those spaces is negligible as compared to that of the ions in the collision cell 14. Therefore, when no CID gas is present in the collision cell 14 (and the gas pressure in the collision cell 14 is approximately equal to the gas pressure around the cell in the analysis chamber 11), it is possible to consider that the detector is located immediately after the exit of the first-stage quadrupole 13, as indicated by numeral 18' in FIG. 2A.

While the mass-scan operation is performed so that the mass-to-charge ratio of the ions passing through the first-stage quadrupole 13 changes over a predetermined mass range, when the temporal change of the signal obtained with the detector 18 is monitored, a peak formed by a group of product ions originating from the standard sample appears at around a certain point in time during the mass-scan period, as shown in FIG. 2B. When the time-delay element D is not present, the peak appears at time t1. When the time-delay element D is present, the peak appears at time t2, which is delayed from time t1 by time difference Δt since the time-delay element D makes the product ions slower to arrive at the detector 18. Even during the period of this time difference Δt, the mass-to-charge ratio of the ions passing through the first-stage quadrupole 13 continues changing. As a result, a mass shift occurs at the time-delay element D by an amount corresponding to the mass-to-charge ratio difference equivalent to the voltage difference V2−V1 in FIG. 2C.

Given that the known mass-to-charge ratio of the standard sample is Mr, if the time delay of the ions in the collision cell 14 is not taken into consideration, the voltage V1 should correspond to the mass-to-charge ratio Mr. If the time delay of the ions in the collision cell 14 is taken into consideration, the voltage V2 should correspond to the mass-to-charge ratio Mr. Accordingly, based on the mass calibration data collected in the mass-calibration measurement, the data processor 25 creates mass calibration data based on the relationship between the mass-scan voltage used at the point in time where the peak was detected and the mass-to-charge ratios of the components included in the standard sample. In general, a standard sample contains a plurality of standard reference materials having different mass-to-charge ratios. Therefore, it is possible to create accurate mass calibration data, with the influence of the time-delay element D reflected therein, by investigating the relationship between the voltage at which a peak appeared and the theoretical value of the mass-to-charge ratio for each standard reference material. The mass calibration data can be prepared in any form, such as a mathematical formula or a table.

The delay time of the ions due to the time-delay element D depends on the CID gas pressure in the collision cell 14, the kinetic energies that the ions possess when they enter the collision cell 14 (collision energy), and other factors. The former can be rephrased as the flow rate of the CID gas introduced into the collision cell 14, while the latter can be rephrased as the potential difference between the DC bias voltage applied to the collision cell 14 and the DC bias voltage applied to the first-stage quadrupole 13 located in the previous stage. Both the CID gas pressure and the collision energy are included in the dissociating conditions which affect the dissociation efficiency or other aspects of the measurement. When necessary, these conditions can be changed manually by a user or automatically by the system. Therefore, it is preferable to prepare optimal mass calibration data for each of such different dissociating conditions.

For this purpose, in the triple quadrupole mass spectrometer, the controller 24 conducts a mass-calibration measurement of the standard sample while changing the CID gas pressure in stages by regulating the opening of the gas valve 16, or changing the collision energy in stages by varying the DC bias voltage. Meanwhile, the data processor 25 collects mass calibration data under each of the different conditions. The collected mass calibration data, which show the relationship between the voltage applied to the first-stage quadrupole 13 and the mass-to-charge ratio to be measured, are stored in the calibration data memory 26, with the CID gas pressure, collision energy and other quantities as parameters.

When a command is given through the input unit 27 to perform a measurement including a mass-scan operation of the first-stage quadrupole 13 and a dissociating operation of the collision cell 14, such as a neutral loss scan measurement or precursor ion scan measurement on a target sample, the controller 24 retrieves, from the calibration data memory 26, a set of mass calibration data corresponding to the CID gas pressure and the collision energy at that point in time. The controller 24 uses the retrieved mass calibration data to control the Q1 power source 21 so that the voltage applied to the first-stage quadrupole 13 will vary over a specific range. The use of the mass calibration data reduces the influence of the time delay of the ions passing through the collision cell 14. Therefore, for example, when a neutral loss scan measurement is carried out, a product ion from which a specified neutral loss has desorbed can be detected with high sensitivity. Furthermore, a mass spectrum having an accurate mass axis can be created in the data processor 25.

Second Embodiment

Figure 4:
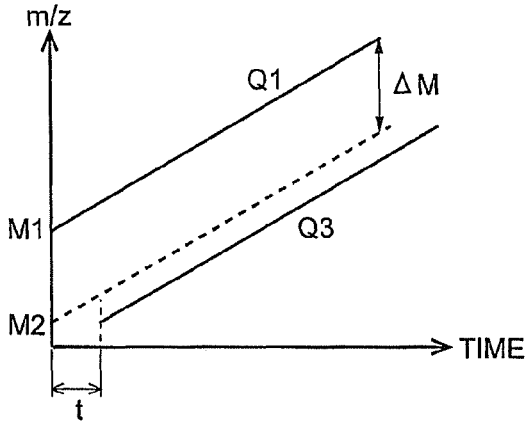
FIG. 4 is a model diagram for explaining an operation characteristic of the triple quadrupole mass spectrometer according to the second embodiment.

As another embodiment (second embodiment) of the present invention, a triple quadrupole mass spectrometer is hereinafter described by means of FIGS. 3 and 4. FIG. 3 is a schematic configuration diagram of the triple quadrupole mass spectrometer of the second embodiment, and FIG. 4 is a model diagram for explaining an operation characteristic of the triple quadrupole mass spectrometer of the second embodiment. In FIG. 3, the same components as used in the previously described triple quadrupole mass spectrometer of the first embodiment are denoted by the same numerals. In the triple quadrupole mass spectrometer of the second embodiment, a mass-scan correction data memory 28, in which a set of predetermined correction data is previously stored, is connected to the controller 24.

As already explained, when a CID gas is introduced into the collision cell 14 to dissociate ions, the ions undergo a significant time delay when passing through the collision cell 14. To address this problem, the mass spectrometer of the present embodiment is configured so that the point in time for initiating the mass-scan operation of the third-stage quadrupole 17 in a neutral loss scan measurement is delayed from the point in time for initiating the mass-scan operation of the first-stage quadrupole 13 by an amount corresponding to the time delay of the ions in the collision cell 14, rather than controlling the mass-scan operations of the first-stage and third-stage quadrupoles 13 and 17 so as to simply maintain a constant mass-to-charge ratio difference between them. FIG. 4 graphically shows the idea underlying the present embodiment, where t denotes the amount of time by which the initiation of the mass-scan operation of the third-stage quadrupole 17 is delayed. As already noted, the time delay of the ions in the collision cell 14 depends on the CID gas pressure, collision energy and other dissociating conditions. Accordingly, the time t should preferably be changed according to these dissociating conditions.

The value of time t most suitable for an appropriate neutral loss scan measurement can be experimentally determined beforehand by the manufacturer of the present device. Accordingly, on the manufacturer's side, an appropriate value of t is determined under various dissociating conditions and the obtained values are stored as correction data in the mass-scan correction data memory 28. When a neutral loss scan measurement is performed on the user's side, the controller 24 determines the mass-to-charge ratio difference ΔM according to the mass-to-charge ratio of the neutral loss specified through the input unit 27, and retrieves, from the mass-scan correction data memory 28, the value of time t corresponding to the dissociating condition at that point in time. Then, the controller 24 determines a mass-scan pattern for the first-stage quadrupole 13 and the third-stage quadrupole 17 as shown in FIG. 4, and controls the Q1 power source 21 and the Q3 power source 23 according to that pattern. As a result, a product ion from which the specified neutral loss has been desorbed can be detected with high sensitivity in the neutral loss scan measurement. Furthermore, a mass spectrum having an accurate mass axis can be created in the data processor 25.

Third Embodiment

Figure 5:
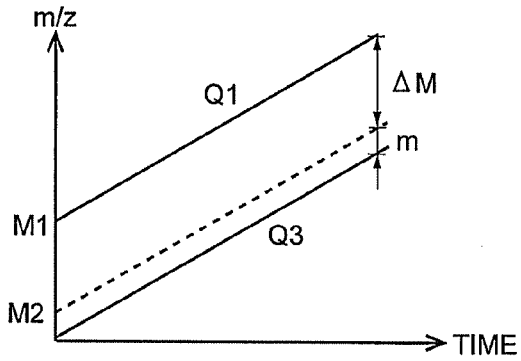
FIG. 5 is a model diagram showing an operation characteristic of a triple quadrupole mass spectrometer according to another embodiment (third embodiment) of the present invention.
Figure 6:
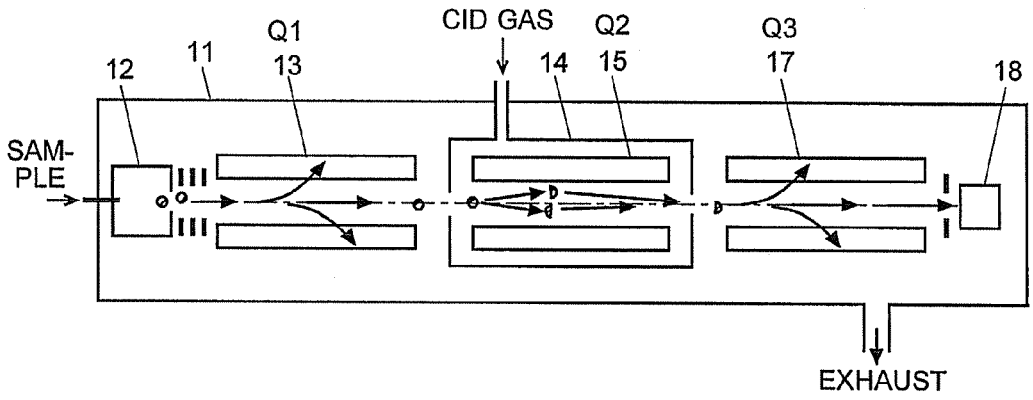
FIG. 6 is a schematic configuration diagram of a conventional and common type of quadrupole mass spectrometer.
Figure 7A:
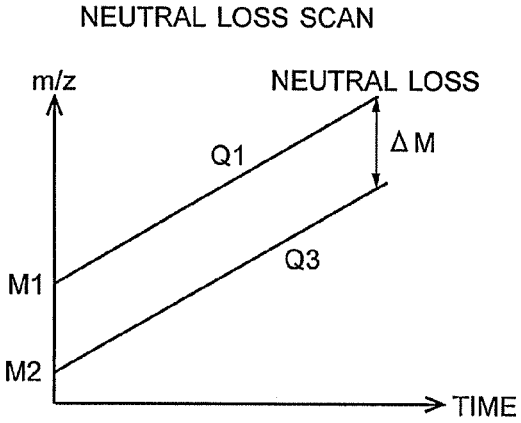
FIGS. 7A and 7B are model diagrams showing a change in the mass-to-charge ratio of the ions selected by the first-stage and third-state quadrupoles in a neutral loss scan measurement and a precursor ion scan measurement.
Figure 7B:
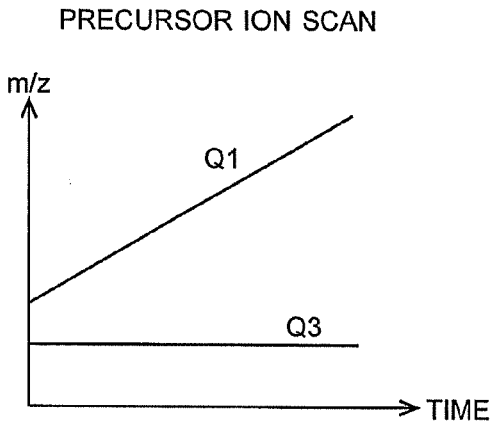

As yet another embodiment (third embodiment) of the present invention, a triple quadrupole mass spectrometer is hereinafter described by means of FIG. 5. FIG. 5 is a model diagram showing an operation characteristic of the triple quadrupole mass spectrometer of the third embodiment. The configuration of the present triple quadrupole mass spectrometer is basically identical to that of the second embodiment and hence will not be described.

In the case of the triple quadrupole mass spectrometer of the second embodiment, the delay time t for initiating the mass-scan operation of the third-stage quadrupole 17 under various dissociating conditions is stored as correction data in the mass-scan correction data memory 28. By contrast, in the triple quadrupole mass spectrometer of the third embodiment, a set of data for correcting the mass-to-charge ratio difference in the mass-scan operation is stored in the mass-scan correction data memory 28. That is to say, when a time delay of ions occurs in the collision cell 14, an ion having a predetermined mass-to-charge ratio and thereby allowed to pass through the first-stage quadrupole 13 will be introduced into the third-stage quadrupole 17 at a point in time delayed from the expected time. Therefore, the observed difference between the mass-to-charge ratio of the ion passing through the first-stage quadrupole 13 and that of the ion passing through the second-stage quadrupole 17 will actually be a decreased value. This problem can be solved by widening the mass-to-charge difference from ΔM to ΔM+m, where the added value m corresponds to the amount by which the mass-to-charge ratio difference is decreased from the expected value.

For example, the manufacturer of the present device determines an appropriate additional value m under various dissociating conditions and stores the obtained values as correction data in the mass-scan correction data memory 28. When a neutral loss scan measurement is performed on the user's side, the controller 24 determines the mass-to-charge ratio difference ΔM according to the mass-to-charge ratio of the neutral loss specified through the input unit 27, and retrieves, from the mass-scan correction data memory 28, the additional value m corresponding to the dissociating condition at that point in time. Then, the controller 24 determines a mass-scan pattern for the first-stage and third-stage quadrupoles 13 and 17 as shown in FIG. 5, and controls the Q1 power source 21 and the Q3 power source 23 according to that pattern. As a result, a product ion from which the specified neutral loss has been desorbed can be detected with high sensitivity in the neutral loss scan measurement. Furthermore, a mass spectrum having an accurate mass axis can be created in the data processor 25.

Fourth Embodiment

As yet another embodiment (fourth embodiment) of the present invention, a triple quadrupole mass spectrometer is hereinafter described. The configuration of the triple quadrupole mass spectrometer of the fourth embodiment is basically identical to that of the first embodiment. The difference from the first embodiment exists in the operation of the mass-calibration measurement which is performed under the control of the controller 24 in order to obtain mass calibration data to be stored in the calibration data memory 26. In other words, a built-in control program of the controller 24 for the mass-calibration measurement is different from the program used in the first embodiment.

More specifically, the difference is as follows: In the first embodiment, the controller 24 controls the Q3 power source 23 so as to apply only the radio-frequency voltage to the third-stage quadrupole 17 during the mass-calibration measurement so that no substantial mass separation will occur in the third-stage quadrupole 17. By contrast, in the fourth embodiment, a mass separation is performed in the third-stage quadrupole 17 so that a specific product ion created by the dissociation of a precursor ion originating from the standard sample for calibration is allowed to pass through.

To obtain a detection signal corresponding to a specific product ion, it is necessary to previously know the mass-to-charge ratio of a product ion originating from the standard sample. The features of the standard sample, i.e. the molecular weights and compositions of the sample components as well as the mass-to-charge ratios of ions to be created from these components, are definitely known. Therefore, in normal cases, the mass-to-charge ratio of the product ion can be definitely known beforehand. Alternatively, the mass-to-charge ratio of the desired product ion may be previously and experimentally determined, for example, by another, already calibrated mass spectrometer. Even when the mass-to-charge ratio of the desired product ion is previously known, if the mass shift (i.e. the difference between the mass-to-charge ratio being set as the target of the analysis and the actually selected mass-to-charge ratio) in the third-stage quadrupole 17 is too large, the ion cannot pass through the third-stage quadrupole 17. Accordingly, it is necessary to previously reduce the mass shift in the third-stage quadrupole 17 by mass calibration. For this purpose, a mass calibration of the third-stage quadrupole 17 under the condition free from the influences from the time-delay element D due to the collision cell 14 may be preferably performed before the mass calibration data for the first-stage quadrupole 13 is obtained.

The period of time for ions to pass through the third-stage quadrupole 17 barely changes regardless of whether or not the mass separation of the ions is performed in the third-stage quadrupole 17. Therefore, when an appropriate voltage is applied to the third-stage quadrupole 17 so that the product ion originating from the standard sample can pass through the third-stage quadrupole 17, if the mass-to-charge ratio of the ion passing through the first-stage quadrupole 13 is varied over a predetermined range, the temporal change of the signal obtained by the detector 18 will have a peak corresponding to that specific product ion originating from the standard sample, as shown in FIG. 2B. The delay time of this peak from reference time t1 should be equal to the value Δt in the first embodiment. Based on the thus obtained data, the data processor 25 can create mass calibration data, with reference to the relationship between the level of the mass-scan voltage at which the peak of the concerned product ion was detected and the mass-to-charge ratios of the components of the standard sample.

Figure 8A:
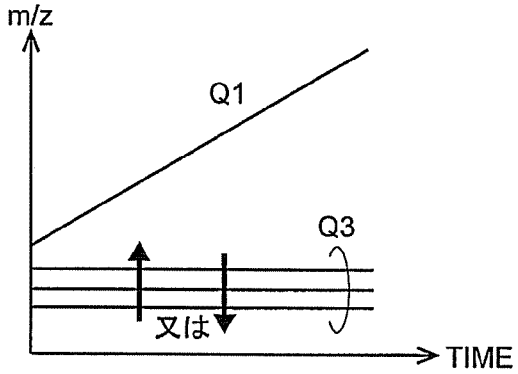
FIGS. 8A and 8B are model diagrams showing an operation characteristic of a triple quadrupole mass spectrometer according to the fourth embodiment.
Figure 8B:
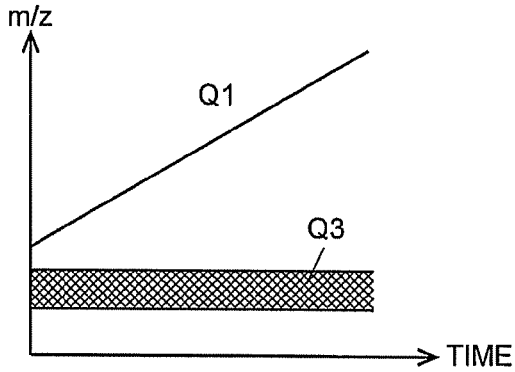

When the mass-to-charge ratio of the product ion is not precisely known, or when the mass shift is expected to be considerably large due to an inappropriate mass calibration of the third-stage quadrupole 17, it is possible that the product ion originating from the standard sample cannot actually pass through the third-stage quadrupole 17 even if an appropriately controlled voltage for allowing the concerned product ion to pass through the third-stage quadrupole 17 is applied from the Q3 power source 23 to the third-stage quadrupole 17. Even in such a case, it should be possible to make the product ion pass through the third-stage quadrupole 17 and be detected; for example, this can be achieved by repeating the analysis while gradually varying the voltage applied to the third-stage quadrupole 17 and thereby shifting the mass-to-charge ratio at which an ion is allowed to pass through (see FIG. 8A). Another possible method is to lower the mass-resolving power for the mass selection by the third-stage quadrupole 17 (see FIG. 8B). In this case, the product ion can be detected even if the mass shift is to some extent large. In this case, therefore, by repeating the analysis a plurality of times while gradually narrowing the voltage applied to the third-stage quadrupole 17 so as to improve the mass-resolving power around the location of the peak of the concerned product ion, it is possible to determine the voltage at which the product ion can be detected with high mass-resolving power. In this manner, a sufficient amount of data for the mass calibration of the first-stage quadrupole 13 can be collected, and the mass calibration data can be created from the collected data.

Fifth Embodiment

In the sixth embodiment, the mass-calibration measurement is performed in the form of a precursor ion scan measurement. It is also possible to perform the mass-calibration measurement as a neutral loss scan measurement, as will be hereinafter described as the fifth embodiment. The configuration of the triple quadrupole mass spectrometer of the fifth embodiment is basically identical to that of the first embodiment. The difference from the first and fourth embodiments exists in the operation of the mass-calibration measurement which is performed under the control of the controller 24 in order to obtain mass calibration data to be stored in the calibration data memory 26.

Figure 9A:
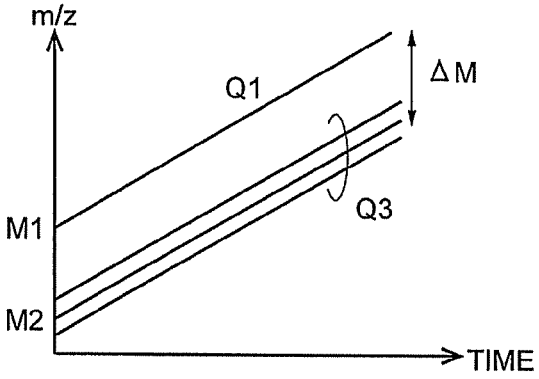
FIGS. 9A and 9B are model diagrams showing an operation characteristic of a triple quadrupole mass spectrometer according to the fifth embodiment.

In the neutral loss scan measurement, it is necessary to set the difference between the mass-to-charge ratio of the precursor ion and that of the product ion, and synchronously drive the first-stage quadrupole 13 and the third-stage quadrupole 17. Even if the difference in the mass-to-charge ratio between the precursor ion and the product ion originating from the standard sample, if the overall mass shift of the first-stage quadrupole 13 and the third-stage quadrupole 17 is large, the desired product ion originating from the standard sample cannot pass through the third-stage quadrupole 17, so that the peak of the concerned product ion will not be detected. To address this problem, for example, when a mass scan aimed at a known neutral loss has been performed by respectively operating the first-stage quadrupole 13 and the third-stage quadrupole 17 at a predetermined scan speed (i.e. mass-resolving power) and yet no peak due to the product ion has been detected, the neutral loss scan measurement is repeated while gradually changing the setting of the neutral loss (see FIG. 9A). By this method, it should be possible to detect the desired product ion at some point in time.

Figure 9B:
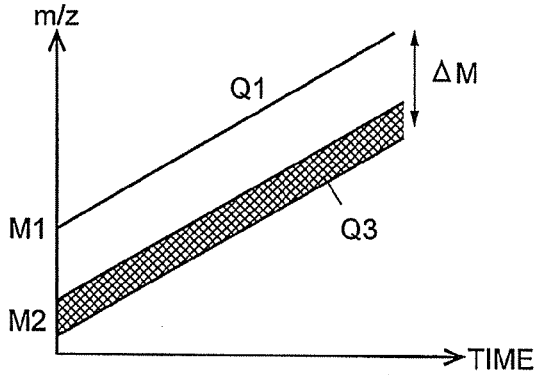

Another possible method is to lower the mass-resolving power for the mass selection by the third-stage quadrupole 17 (see FIG. 9B). In this case, the product ion can be detected even if the mass shift is to some extent large. In this case, therefore, by repeating the analysis a plurality of times while gradually narrowing the voltage applied to the third-stage quadrupole 17 so as to improve the mass-resolving power around the location of the peak of the concerned product ion, it is possible to determine the voltage at which the product ion can be detected with high mass-resolving power. In this manner, a sufficient amount of data for the mass calibration of the first-stage quadrupole 13 can be collected, and mass calibration data can be created from the collected data.

As in the first embodiment, it is preferable in any of the fourth and fifth embodiments to repeat the same analysis every time the dissociating conditions (i.e. the CID gas pressure, collision energy and so on) are changed, so as to prepare optimal mass calibration data for each of the different dissociating conditions.

Sixth Embodiment

Figure 10:
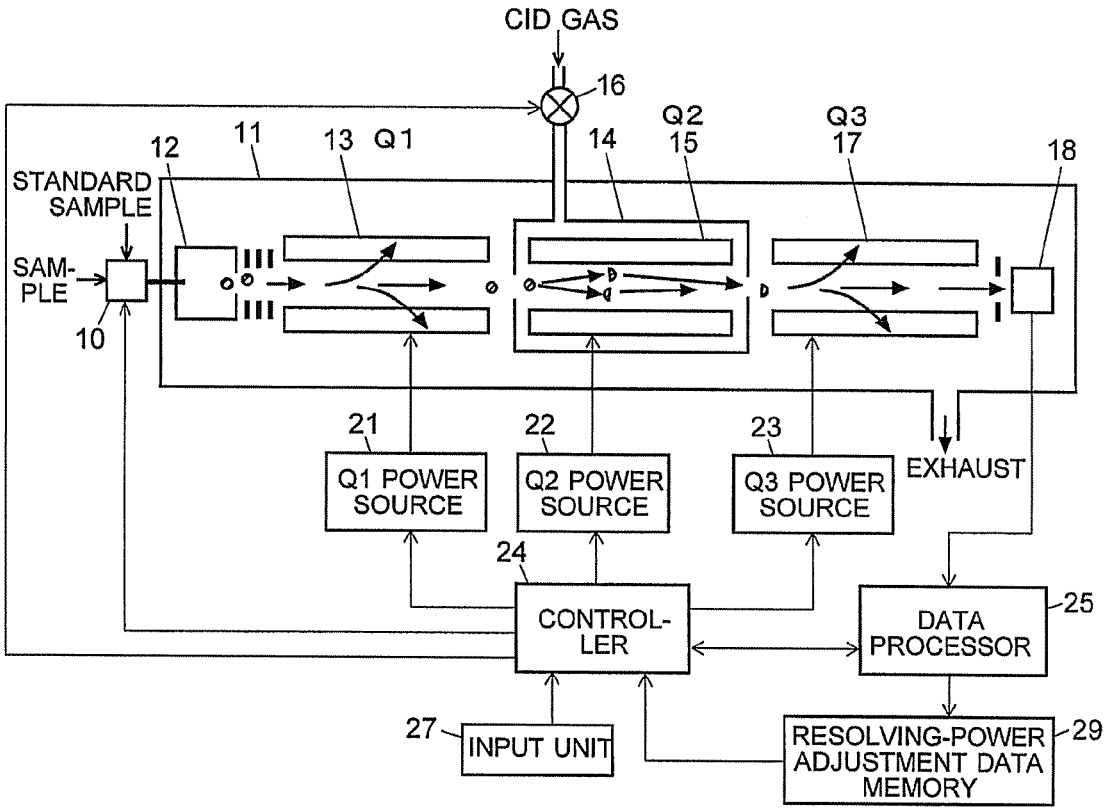
FIG. 10 is a schematic configuration diagram of a triple quadrupole mass spectrometer according to the sixth embodiment.

In the triple quadrupole mass spectrometers according to the first, fourth and fifth embodiments, the mass calibration is performed to compensate for the mass shift in the first-stage quadrupole 13 which occurs mainly due to the delay of the ions in the collision cell 14, and to obtain a mass spectrum having an accurate mass axis. In a similar manner, the mass-resolving power of the first-stage quadrupole 13 can also be adjusted. Similar to the first embodiment, the triple quadrupole mass spectrometer of the sixth embodiment acquires resolving-power adjustment data for the adjustment of the mass-resolving power under the condition that no mass separation occurs in the third-stage quadrupole 17. A schematic configuration of the system is shown in FIG. 10.

When a mass scan is performed in the first-stage quadrupole, the voltage $\pm(U1+V1\cdot\cos\omega t)$ applied to this quadrupole 13 is controlled so that the level U of the DC voltage and the amplitude V of the radio-frequency voltage are individually varied while maintaining the ratio U/V at a constant value. The adjustment of the mass-resolving power can be achieved by controlling the level U of the DC voltage.

More specifically, the mass-resolving power can be adjusted by controlling the "gain" and "offset." The "gain" is the parameter for varying the amount of change in the voltage level U relative to the amount of change in the mass-to-charge ratio. The "offset" is the parameter for changing the absolute value of the voltage level U at the beginning of the change (or scan) of the mass-to-charge ratio. In MS/MS analyses, setting a higher mass-resolving power in the first-stage quadrupole 13 improves the selectivity of the precursor ion; however it also decreases the intensity of the precursor ion and hence lowers the detection sensitivity of the product ions. Therefore, it is important to adjust the mass-resolving power of the first-stage quadrupole 13 to a target level rather than set it at the highest possible level. The target level may be automatically set by the system or manually specified by a user.

Upon receiving a command for initiating the measurement for the mass-resolving power adjustment, the controller 24, as in the case of the mass-calibration measurement in the first embodiment, introduces a CID gas into the collision cell 14 and applies only a radio-frequency voltage to the third-stage quadrupole 17 so that no substantial mass separation will occur in the third-stage quadrupole 17. Accordingly, the various kinds of product ions produced by the dissociation of the same precursor ion in the collision cell 14 undergo no mass separation in the third-stage quadrupole 17 and hence arrive at the detector 18 in the form of a packet.

Figure 11A:
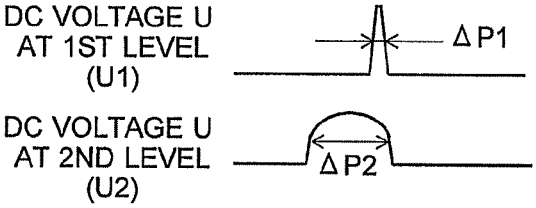
FIGS. 11A and 11B are model diagrams showing an operation characteristic of the triple quadrupole mass spectrometer according to the sixth embodiment.
Figure 11B:
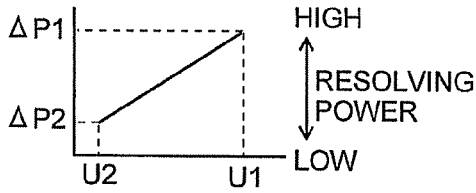

Then, a mass scan is performed so that the mass-to-charge ratio of the ions that can pass through the first-stage quadrupole 13 varies over a predetermined mass range, and this mass scan is performed under two conditions: one condition is such that the DC voltage U is set at the value corresponding to a predetermined high mass-resolving power, and the other condition is such that U is set at the value corresponding to a predetermined low mass-resolving power. When the temporal change of the detection signal is monitored during the mass-scan operation, a peak formed by a group of product ions originating from the standard sample appears at around a certain point in time, as shown in FIG. 11A. The width of this peak significantly depends on the setting of the voltage level U. On the other hand, even if a group of precursor ions having the same mass-to-charge ratio are simultaneously injected into the collision cell 14, these ions will have different amounts of kinetic energy due to the collision with the CID gas, which results in a difference in the speed of the ions and hence a variation in the time of arrival of the ions at the detector 18. That is to say, the collision cell 14 has the effect of substantially lowering the mass-resolving power in the first-stage quadrupole 13. The width of the ion peak obtained by the detector 18 reflects the mass-resolving power of the first-stage quadrupole 13 including such an influence from the collision cell 14. Taking this into account, the data processor 25 analyzes the detection data obtained in the previously described measurement for the mass-resolving power adjustment to create mass-resolving power adjustment data, as shown in FIG. 11B, based on the relationship between the set values U1 and U2 of the voltage level U of the DC voltage and the peak widths $\Delta P1$ and $\Delta P2$. The mass-resolving power adjustment data may be created in any other form, such as an equation or table.

As already noted, the spread of the ion-peak width includes the influence from the collision cell 14. This means that the relationship between the mass-resolving power of the first-stage quadrupole 13 and the setting of the voltage level U of the DC voltage depends on the pressure of the CID gas in the collision cell 14, the collision energy, and other dissociating conditions. Accordingly, as in the case of the mass calibration data, it is desirable to obtain mass-resolving power adjustment data for each of the various dissociating conditions and store the obtained data in the resolving-power adjustment data memory 29.

When a command for initiating a measurement including a mass-scan operation by the first-stage quadrupole 13 and a dissociating operation by the collision cell 14, such as a neutral loss scan measurement or precursor ion scan measurement of a target sample, is entered through the input unit 27, the controller 24 reads from the resolving-power adjustment data memory 29 a resolving-power adjustment data corresponding to the target level of the mass-resolving power under the CID gas pressure and collision energy at the moment. The controller 24 uses this resolving-power adjustment data to control the Q1 power source 21 so as to scan the voltage applied to the first-stage quadrupole 13. As a result, the mass-resolving power of the first-stage quadrupole 13 will be at the target level, where a mass spectrum with a desired mass accuracy and sensitivity can be obtained. Even if the CID gas pressure and/or any other conditions are changed, the mass-resolving power of the first-stage quadrupole 13 will be appropriately set to the target level without being affected by the change in those conditions.

[Other Variations]

In the triple quadrupole mass spectrometer of the sixth embodiment, the measurement for the mass-resolving power adjustment is performed without performing a substantial mass separation in the third-stage quadrupole 17. Obviously, this system can be changed so that the measurement for the mass-resolving power adjustment is performed in the form of a precursor ion scan measurement, as in the triple quadrupole mass spectrometer of the fourth embodiment, or a neutral loss scan measurement, as in the triple quadrupole mass spectrometer of the fifth embodiment. In general, when the mass-scan operations are performed in both the first and third stage quadrupoles 13 and 17, the influences of the mass-resolving powers of both two quadrupoles will appear in the mass analysis data. Therefore, as already explained, when the resolving-power adjustment data for the adjustment of the mass-resolving power of the first-stage quadrupole 13 must be obtained, it is necessary to remove or isolate the influence of the mass-resolving power of the third-stage quadrupole 17. This can be achieved, for example, by setting the mass-resolving power of the third-stage quadrupole 17 to a low level during the mass separation so that the spread of the peak due to the influence of the mass-resolving power of the first-stage quadrupole 13, which is higher than that of the third-stage quadrupole 17, will be noticeable in an ion peak.

It should be noted that any of the previous embodiments is a mere example of the present invention, and any change, addition or modification appropriately made within the spirit of the present invention will be obviously included in the scope of claims of the present application.

What is claimed is:

1. An MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, further comprising:

a) a calibrating analysis execution means for collecting mass analysis data by introducing a CID gas into the collision cell, by operating the first mass separator to perform a mass scan of a sample having a known mass-to-charge ratio, and by operating the second mass separator to selectively analyze a product ion originating from the sample;

b) a calibration information memory means for creating mass calibration information for the first mass separator, based on the mass analysis data collected by the calibrating analysis execution means, the mass calibration information reflecting a time delay of an ion in the collision cell, and for memorizing the mass calibration information; and c) an actual analysis execution means for collecting mass analysis data for a target sample by controlling a mass-scan operation of the first mass separator by using the mass calibration information memorized in the calibration information memory means, at least when a neutral loss scan or a precursor ion scan is performed.

2. An MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, further comprising:

a) a calibrating analysis execution means for collecting mass analysis data by introducing a CID gas into the collision cell and synchronously driving the first mass separator and the second mass separator to perform a neutral loss scan aimed at a known or expected neutral loss for a sample having a known mass-to-charge ratio;

b) a calibration information memory means for creating mass calibration information for the first mass separator, based on the mass analysis data collected by the calibrating analysis execution means, the mass calibration information reflecting a time delay of an ion in the collision cell, and for memorizing the mass calibration information; and c) an actual analysis execution means for collecting mass analysis data for a target sample by controlling a mass-scan operation of the first mass separator by using the mass calibration information memorized in the calibration information memory means, at least when a neutral loss scan or a precursor ion scan is performed.

3. The MS/MS mass spectrometer according to claim 1, wherein:

the calibrating analysis execution means collects mass analysis data under various conditions in which at least one among the pressure of the collision-induced dissociation gas in the collision cell, the collision energy, and the mass-scan speed of the first mass separator is varied in plural ways; and the calibration information memory means creates and memorizes mass calibration information for each different condition.

4. The MS/MS mass spectrometer according to claim 2, wherein:

the calibrating analysis execution means collects mass analysis data under various conditions in which at least one among the pressure of the collision-induced dissociation gas in the collision cell, the collision energy, and the mass-scan speed of the first mass separator is varied in plural ways; and the calibration information memory means creates and memorizes mass calibration information for each different condition.

5. An MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, further comprising:

a) an adjusting analysis execution means for collecting mass analysis data by analyzing a sample having a known mass-to-charge ratio by performing a mass scan in the first mass separator under a condition that a CID gas is introduced into the collision cell while no substantial mass separation is performed in the second mass separator;

b) an adjustment information memory means for creating mass-resolving power adjustment information for the first mass separator, based on the mass analysis data collected by the adjusting analysis execution means, the mass-resolving power adjustment information reflecting an increase in a variation of kinetic energies of ions in the collision cell, and for memorizing the mass-resolving power adjustment information; and c) an actual analysis execution means for collecting mass analysis data for a target sample by controlling a mass-scan operation while using the mass-resolving power adjustment information memorized in the calibration information memory means so that the mass-resolving power of the first mass separator will be adjusted to a target value, at least when a neutral loss scan or a precursor ion scan is performed.

6. An MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, further comprising:

a) an adjusting analysis execution means for collecting mass analysis data by introducing a CID gas into the collision cell, by operating the first mass separator to perform a mass scan of a sample having a known mass-to-charge ratio, and by operating the second mass separator to selectively analyze a product ion originating from the sample;

b) an adjustment information memory means for creating mass-resolving power adjustment information for the first mass separator, based on the mass analysis data collected by the adjusting analysis execution means, the mass-resolving power adjustment information reflecting an increase in a variation of kinetic energies of ions in the collision cell, and for memorizing the mass-resolving power adjustment information; and c) an actual analysis execution means for collecting mass analysis data for a target sample by controlling a mass-scan operation while using the mass-resolving power adjustment information memorized in the calibration information memory means so that the mass-resolving power of the first mass separator will be adjusted to a target value, at least when a neutral loss scan or a precursor ion scan is performed.

7. An MS/MS mass spectrometer including a first mass separator for selecting, as a precursor ion, an ion having a specific mass-to-charge ratio from various kinds of ions, a collision cell for dissociating the precursor ion by making the precursor ion collide with a collision-induced dissociation (CID) gas, and a second mass separator for selecting an ion having a specific mass-to-charge ratio from various kinds of product ions created by dissociation of the precursor ion, further comprising:

a) an adjusting analysis execution means for collecting mass analysis data by introducing a CID gas into the collision cell and synchronously driving the first mass separator and the second mass separator to perform a neutral loss scan aimed at a known or expected neutral loss for a sample having a known mass-to-charge ratio;

b) an adjustment information memory means for creating mass-resolving power adjustment information for the first mass separator, based on the mass analysis data collected by the adjusting analysis execution means, the mass-resolving power adjustment information reflecting an increase in a variation of kinetic energies of ions in the collision cell, and for memorizing the mass-resolving power adjustment information; and c) an actual analysis execution means for collecting mass analysis data for a target sample by controlling a mass-scan operation while using the mass-resolving power adjustment information memorized in the calibration information memory means so that the mass-resolving power of the first mass separator will be adjusted to a target value, at least when a neutral loss scan or a precursor ion scan is performed.

8. The MS/MS mass spectrometer according to claim 5, wherein:

the adjusting analysis execution means collects mass analysis data under various conditions in which at least one among the pressure of the collision-induced dissociation gas in the collision cell, the collision energy, and the mass-scan speed of the first mass separator is varied in plural ways; and the adjustment information memory means creates and memorizes mass calibration information for each different condition.

9. The MS/MS mass spectrometer according to claim 6, wherein:

the adjusting analysis execution means collects mass analysis data under various conditions in which at least one among the pressure of the collision-induced dissociation gas in the collision cell, the collision energy, and the mass-scan speed of the first mass separator is varied in plural ways; and the adjustment information memory means creates and memorizes mass calibration information for each different condition.

10. The MS/MS mass spectrometer according to claim 7, wherein:

the adjusting analysis execution means collects mass analysis data under various conditions in which at least one among the pressure of the collision-induced dissociation gas in the collision cell, the collision energy, and the mass-scan speed of the first mass separator is varied in plural ways; and the adjustment information memory means creates and memorizes mass calibration information for each different condition.

* * * * *